US007681376B2

(12) United States Patent
Hirata et al.

(10) Patent No.: US 7,681,376 B2
(45) Date of Patent: Mar. 23, 2010

(54) MANUFACTURING METHOD FOR ELECTRONIC, ELECTRIC OR OTHER PRODUCTS SUCH AS FLAT-PANEL DISPLAY DEVICES AND PACKAGE THEREFOR

(75) Inventors: Katsuyasu Hirata, Hyogo (JP); Takayuki Iizuka, Hyogo (JP)

(73) Assignee: Toshiba Matsushita Display Technology Co., Ltd,, Tokyo (JP)

( * ) Notice: Subject to any disclaimer, the term of this patent is extended or adjusted under 35 U.S.C. 154(b) by 798 days.

(21) Appl. No.: 11/540,579

(22) Filed: Oct. 2, 2006

(65) Prior Publication Data

US 2007/0077847 A1 Apr. 5, 2007

(30) Foreign Application Priority Data

Sep. 30, 2005 (JP) ..... 2005-288395

(51) Int. Cl.
*B65B 11/58* (2006.01)
*B65B 23/00* (2006.01)
*B65B 9/06* (2006.01)

(52) U.S. Cl. ..... 53/449; 53/430; 53/472; 53/170; 206/521

(58) Field of Classification Search ..... 53/410, 53/411, 430, 449, 472, 131.1, 170, 173, 241; 206/521, 585, 587, 593, 454, 451
See application file for complete search history.

(56) References Cited

U.S. PATENT DOCUMENTS 2,893,550 A * 7/1959 Sandmeyer ..... 206/499
2,956,672 A * 10/1960 Kirkpatrick ..... 206/497
4,235,065 A * 11/1980 Freeman ..... 53/472
4,865,200 A * 9/1989 Sullivan et al. ..... 206/583
5,136,827 A * 8/1992 Sawaya ..... 53/453
5,388,701 A * 2/1995 Ridgeway ..... 206/583

(Continued)

FOREIGN PATENT DOCUMENTS

JP 2000-310785 11/2000

(Continued)

OTHER PUBLICATIONS

Machine Translation of Japanese publication 2005-289482, generated Sep. 24, 2009.*

*Primary Examiner*—Paul R Durand
(74) *Attorney, Agent, or Firm*—Oblon, Spivak, McClelland, Maier & Neustadt, L.L.P.

(57) ABSTRACT

A method for manufacturing electronic, electric or other products such as flat-panel display devices, for coping with change of product size and for curbing damage on the products and dust generation by smaller cost of packaging, according to one embodiment, comprising; sequentially placing first products as to be sandwiched by a resin-sheet band and as to be arrayed in a row while forming joined areas as to form receptacles respectively for the first products, thus forming a band-shaped package; winding the band-shaped package around a shock-absorbent core and placing them into an inner box as non-displaceable; placing the inner box in an outer box as to be supported from inner face of the outer box through partitions or spacers; and then transporting or storing in such a state while keeping the resin-sheet face as substantially vertical, as to be used for producing second products.

5 Claims, 6 Drawing Sheets

U.S. PATENT DOCUMENTS

| | | | | | |
|---|---|---|---|---|---|
| 5,549,202 | A | * | 8/1996 | Whiteside | 206/436 |
| 5,678,695 | A | * | 10/1997 | Ridgeway et al. | 206/583 |
| 5,718,098 | A | * | 2/1998 | Grosskopf et al. | 53/397 |
| 6,006,917 | A | * | 12/1999 | Loeffler | 206/583 |
| 6,941,729 | B2 | * | 9/2005 | Dal Pozzo | 53/453 |
| 6,948,618 | B2 | * | 9/2005 | Luu et al. | 206/594 |
| 6,957,522 | B2 | * | 10/2005 | Baldwin et al. | 53/411 |
| 7,096,648 | B2 | * | 8/2006 | Kawada | 53/449 |
| 7,464,517 | B2 | * | 12/2008 | Akatsuka et al. | 53/433 |
| 2005/0241988 | A1 | | 11/2005 | Hirata et al. | |

FOREIGN PATENT DOCUMENTS

| | | | |
|---|---|---|---|
| JP | 2001-348008 | | 12/2001 |
| JP | 2002-332023 | | 11/2002 |
| JP | 2002-337951 | | 11/2002 |
| JP | 2003-95216 | | 4/2003 |
| JP | 2004-18094 | | 1/2004 |
| JP | 2004-106907 | | 4/2004 |
| JP | 2004-231257 | | 8/2004 |
| JP | 2005-153888 | | 6/2005 |
| JP | 2005-289482 | * | 10/2005 |

* cited by examiner

MANUFACTURING METHOD FOR ELECTRONIC, ELECTRIC OR OTHER PRODUCTS SUCH AS FLAT-PANEL DISPLAY DEVICES AND PACKAGE THEREFOR

FIELD OF THE INVENTION

This invention relates to a process for manufacturing electronic or electric products such as flat-panel display devices, or other products, as well as packages for such process and products. The term of electronic or electric products will be used to encompass not only final products but also semifinished products, intermediate products and all kinds of electronic or electric parts or elements. The term of electronic or electric products encompasses; for example, display panels and light-guide plate of small dimensions (1-3 inch in diagonal length of viewing area) or medium dimensions (4-10 inch in the diagonal length); as well as semiconductor chips and printed circuit boards in small thickness dimensions.

BACKGROUND ART

Recently, markets of liquid crystal display devices and other flat-panel display devices grow rapidly. In particular, sharply growing are the markets of small and medium sized ones including those used in mobile phones, personal digital assistants and car navigation systems. In a manufacturing process of the flat-panel display devices, display panels proper or without annexes are manufactured and then mounted with connector boards such as flexible printed circuit boards (FPC) as to form display panels with annexes. Subsequently these are assembled with backlight devices or the like to form "display panel modules". In common circumstances, manufacturing or assembling processes for the display panels proper, the display panel modules and final or consumer products are made in manufacturing facilities or compounds separate with each other. Thus, display panels proper and display panel modules are transported between them.

For transporting the display panels or the like, so-called traveling trays have been widely used, each of which has a plurality of receptacles. Please see JP-2002-332023A, JP-2004-018094A, JP-2002-337951A, which are Japan's patent application publications. JP-2002-332023A, for example, discloses that receptacles are formed in a matrix manner on a small-depth traveling tray having elasticity, and display panels (display panels proper of its modules) are respectively fitted into the receptacles in a stable manner. In this way, damage or fracture on the display panels due to mechanical shocks or vibrations are curbed even during transportations by trucks, railways or airplanes. Also curbed is coming out of the panels from the receptacles due to the mechanical shocks or vibrations. Please see the JP-2004-018094A for example.

For miniature electronic parts such as semiconductor packages, various investigations are made for using carrier tapes in packaging and transportation of such parts. Please see JP-2003-095216A, JP-2001-348008A for example. The carrier tape is a tape of plastic film provided thereon with a row of receiving recesses in a constant interval. A cover film is used, when necessary, as to be air-tightly attached on fringes of the carrier tape for sealing off the miniature electronic parts such as semiconductor packages, as shown in the JP-2003-095216A. The receiving recesses may be formed by embossing process as in the JP-2003-095216A; or by punching abase film and then attaching an underlying film on such punched film, as shown in the JP-2001-348008A.

The carrier tapes mentioned before are transported in a state being wound around a reel, after a process of placing of the electronic parts respectively in the receiving recesses on an embossed tape or the like and attaching the cover film, as shown in JP-2004-231257A.

Meanwhile, so-called cell cassettes or cell racks have been used for containing the display panels, glass substrates or other intermediate products, when the transportation is made among near-by facilities or near-by process lines within a same building or in a same compound. Please see JP-2000-310785A. The cell rack is formed of a rectangular casing that has a front opening and inward projections on right-hand and left-hand sidewalls, the projections being elongated in a front-rear direction as to catch dozens of the panels or the like that are vertically arrayed in the casing. When for subjecting the display panel or the like to vacuuming process or heating process or the like, the cell rack arrayed with the panels or the like is placed in a chamber for the vacuuming or the heating.

In another way for packaging or transportation of small-depth electronic or electric products, there have been proposed containers that are formed of cardboards and able to be disassembled and folded as flattened. Please see JP-2004-106907A and JP-2005-153888A. The proposed containers that are manufactured by folding and/or assembling of cardboards are used in packaging the small-depth electronic or electric products; and, in particular, parts integrally formed with outer casing take roles of cushioning and retaining structure in place of foamed resin parts.

Conventional methods of using the traveling tray or the carrier tape require that dimensions of the electronic or electric parts almost agree with corresponding dimensions of the receiving recesses. Thus, in response to every switching or changing among types or variations of the electronic or electric products, the trays or tapes having other dimensions of receiving recesses have to be prepared. Meanwhile, the carrier tapes are designed to be solely applicable for miniature-sized electronic or electric parts, thus are difficult to be given with shock absorbency. Hence, no other method than using the traveling trays is imaginable when to transport electronic or electric parts such as the display panels, which have rather large dimensions and are highly susceptible to fracture or damage.

The transportation with the traveling trays causes generation of dusts or particles because edges of the display panel abrade catching surfaces of the trays. Moreover, the transportation system using the traveling trays requires sending back of emptied ones of the traveling trays if to be reused instead of abandoning them; for example after the traveling trays are used for transporting the display panel modules from its production sites to a worksite the consumer products are assembled. In particular, the traveling tray is not able to be baled in a folded-in or compressed form so that procedures of sending back the trays require large space in loading and high cost. Additionally, it is rather difficult to seal off inside of the traveling trays, thus is not easy to avoid intrusion of small particles or of moisture. For enabling the sealing off, it requires a procedure of wrapping up the traveling trays in a piled-up state, with a thick resin sheet, for example.

At a worksite for loading the electronic or electric products as to be filled into the traveling trays, it requires a space for piling up the traveling trays before and after the loading. A procedure of the loading in a sequential manner requires sequential shifting of loading position as well as taking a not-filled one of the traveling trays on an already filled one. Thus, the procedure of the loading is troublesome and requires a lot of working load. Even when using a robot arm, it requires a complicated process.

The method of using "cell racks" for transportation to and from near-by sites requires less workload for the loading procedure. Nevertheless, the method requires spaces for placing and storing the cell racks. When dimensions of the display panel is changed or switched to another ones, the cell racks have to be de-assembled and reassembled so as distance between the sidewalls and/or projection-wise dimensions of the projections on the sidewalls to be adjusted. In otherwise, the cell racks are switched over to other ones in preparation. However, it requires a large stock of the cell racks in various dimensions, thus also increasing spaces for the cell racks. Such reassembling requires a considerable work time and skilled work because precise adjustment is needed. In the cell racks, glass substrates or display panels formed thereof may collide with or abrade inner wall faces of the cell racks so as to cause problems such as fracture or chipping off on glass substrates and forming of "shaving" or dust particles.

As for fore-mentioned containers of the cushioning and retaining structure formed of cardboards, while folding down and recycling are facilitated, air-tight sealing is difficult and the "shaving" or dust particles are apt to be produced so that it is difficult to employ such structure in packaging that have to be kept out of the dust particles. Moreover, assembling procedures for forming the cushioning and retaining structure are rather complicated.

In view of the above drawbacks, it is aimed to cope with change or variations on dimensions of the electronic or electric parts in a swift manner with low cost, to curb damages on the parts and dust formation, and to omit or decrease costs for reusing the packages or containers.

BRIEF SUMMARY OF THE INVENTION

An invention-wise method for manufacturing electronic, electric or other products, comprising: sequentially placing first and flat products as to be sandwiched by a resin-sheet band formed of one or pair of band-shaped flat resin sheet and as to be arrayed in a longitudinal direction of the resin-sheet band; forming joined areas by bonding or fusing faces of the resin-sheet band as to form receptacles respectively for the first flat products; thus forming a band-shaped package in which the first flat products are arrayed in a row with a predetermined interval; winding the band-shaped package around a shock-absorbent core and thereafter placing them in an inner box so that the shock-absorbent core is held as non-displaceable from the inner box; placing the inner box in an outer box in a manner that the inner box is supported from inner face of the outer box through partitions or spacers that are arranged in the outer box, and thereby forming gaps or void spaces between the inner face and the inner box; and transporting or storing the first flat products in the band-shaped package while keeping its sheet face in a substantially vertical direction, as to be used for producing second products.

The term "electronic or electric products" in present invention encompasses a wide variety of products and intermediate products in fields of electronics and electrics, as well as a wide variety of parts, devices and elements to be assembled into such products. The term "resin sheet" encompasses not only sheets of relatively large thickness but also films of relatively small thickness, in so far as being formed of resin.

An invention-wise package for electronic, electric or other flat products, comprising: a resin-sheet band formed of one or pair of band-shaped flat resin sheet; joined areas joining faces of the resin-sheet band by adhesion or fusion; receptacles formed by the joined areas; flat products arrayed in a row in one or more predetermined interval, each of said flat products being received in one of the -receptacles and as being held in a predetermined position on the resin-sheet band by the joined areas as to form a band-shaped package; and fringe extension areas extended from the resin-sheet band on opposite sides on a row of the receptacles; a core, around which the band-shaped package is wound; an inner box, in which the band-shaped package wound around the shock-absorbent core is stored and by which the core is supported as not to be positionally shiftable; an outer box with partitions or spacers, storing the inner box as to be supported from inner faces of the outer box through the partitions or the spacers, with gaps or spaces formed by the partitions or the spacers and interposed between the inner box and the inner faces of the outer box.

By the invention, it is easy to cope with change or variation on dimensions of the electric or electronic products, and is able to curb damage on the products and dust generation so as to decrease cost for packaging and recycling the packages or the like.

BRIEF DESCRIPTION OF THE DRAWING

FIG. 4 is a perspective view same as the FIG. 3 except that the inner boxes are inserted as accommodated into compartments of the outer box and then spacers are fitted in;

FIG. 9 is a perspective view corresponding to the FIG. 4, showing that the inner boxes of the FIG. 8 are inserted as accommodated into compartments of the outer box and then spacers are fitted in.

DETAILED DESCRIPTION OF THE INVENTION

Figure 1:
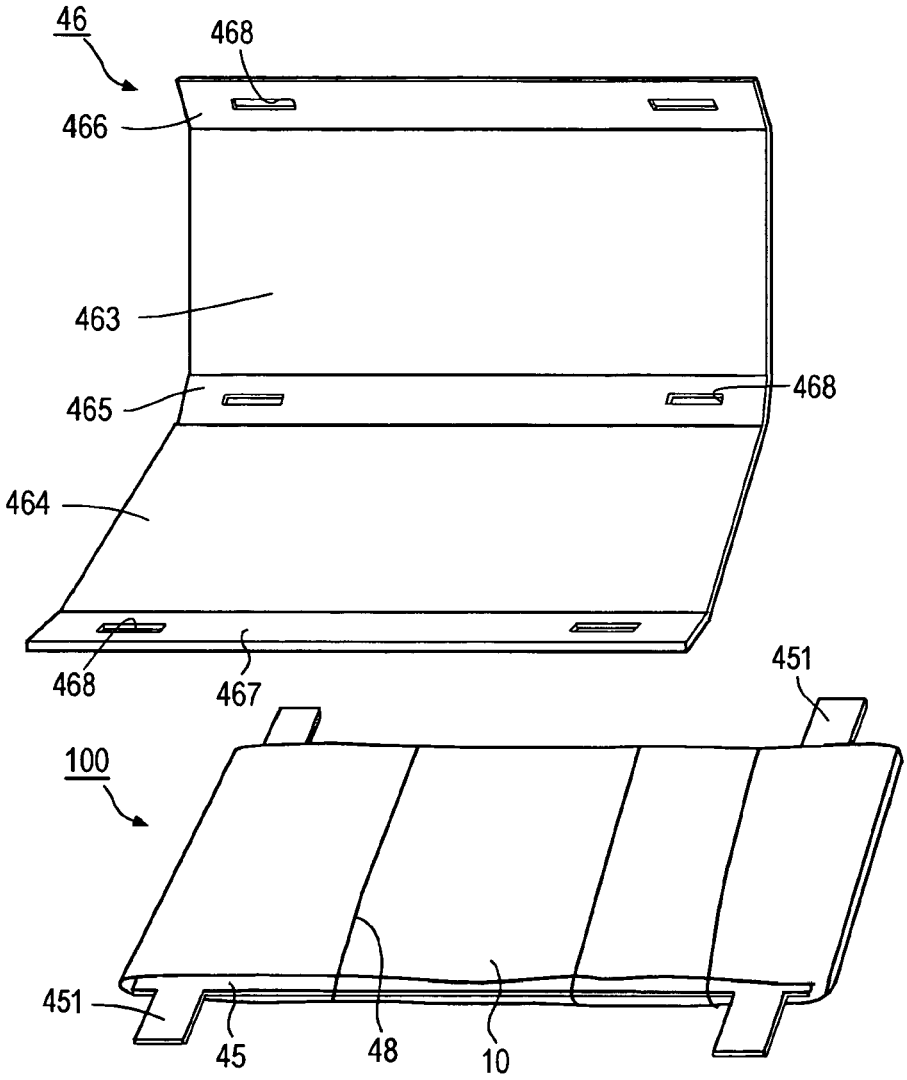
FIG. 1 is a perspective view schematically showing a to-be-cartoned package unit that is formed of a core cardboard and a band-shaped package wound around the core cardboard, and also showing an inner box in a state before closing up.

In view of the drawbacks of the conventional techniques mentioned earlier, the inventors have investigated packaging materials for replacing the traveling trays and/or the cell racks. The investigation is made in particular on foamed materials and laminated composite materials in order to fulfill difficult requirement of satisfying both of following; placing shock absorbent materials as to avoid fracture and/or chipping off, and positioning the display panels or the like as to avoid positional shifting.

On course of the investigation, the inventors have accidentally tried a simple method of placing the display panels between flat sheets of a general-purpose resin and heat-seal-wise connecting the sheets at some or necessary portions. As a result, it was totally surprising that both of holdfasting of the display panels and protecting them from shocks and damages are achieved in occasions under proper conditions. A package in a band shape similar as the carrier tape is also achieved and such band-shaped package was windable on a reel and was able to be fed from the wheel.

On course of further investigation, the inventors found that the band-shaped package may be folded in or folded back at proper portions and be held in such folded state, thus winding around the reel is not necessary. Moreover, by forming such band-shaped package, holding and/or packaging of the electronic or electric parts may be made by processes and devices simpler than those for the tape carrier.

On course of still further investigation, such unconventional band-shaped package is found to be storable in a simple matrix structure formed of cardboards; especially in a general cardboard casing provided with matrix-forming or lattice-wise arranged partitions. Moreover, a further unconventional packaging construction is developed in which the band-shaped package is wound around a core and then is placed in an inner box, which is then stored among the matrix-forming or lattice-wise arranged partitions.

For the band-shaped package, any resin sheet is adoptable if the sheet has some extent of tensile strength, toughness, durability and flexibility and is capable of being bonded together by adhesion or fusion. For such fusion bonding, thermoplastic resin is desirable, whereas laminated sheets having fusion-bonding layer are also adoptable. When bonding is made by adhesive, adoptable are any resin sheets having some adhesiveness, for example, resin sheets having surfaces roughened or polarized by some surface treatment. The resin sheets are possibly formed of elastic resin or foamed resin.

The resin-sheet band is preferably transparent at least either for obverse and reverse faces of the band-shaped package, is more preferably transparent at both of the obverse and reverse faces. Through a transparent sheet, types and states of the electronic or electric products in the package are easily identified and confirmed. For example, production lot numerals or name of variations printed or curved in the electronic or electric products are readily readable, and defective products having failure or breakage in their contour are easily detected. When only either of obverse and reverse part of the resin sheet is formed of transparent sheet, other part may be formed of the foamed resin.

The resin-sheet band preferably has antistatic property on at least either of the obverse and reverse sheet parts of the band-shaped package. Antistatic materials may be blended into resin for forming whole of either of the resin sheet parts. In otherwise, an antistatic layer may be provided on at least either of the resin sheet parts. In such way, undesirable static electricity and damage thereby are curbed during each of packing, transportation and unpacking processes. The antistatic property may also be given by providing a transparent conductive layer that is dispersed with conductive particles formed of Indium-doped tin oxide (ITO) or Indium-doped zinc oxide (IZO), for example. Non-transparent conductive particles such as carbon particles are possibly used for forming an antistatic layer. In a detailed example, a resin sheet disclosed in JP-07(1997)-175592A may be used, which is formed of; a base layer of low-density polyethylene or ethylene-unsaturated ester copolymer; and a surface layer of potassium ionomer of the ethylene-unsaturated ester copolymer. Such layer of the ionomer that is for the antistatic property also facilitates fusion bonding and peeling apart.

Fusion bonding for forming the joined areas may be made by anyone of widely used methods, such as ultrasonic sealing or ultrasonic welding, and impulse heat sealing. When adhesion bonding is to be made, reactive and non-reactive hotmelt adhesives are adoptable as well as other adhesives widely used for plastics. Obverse and reverse sheet parts of the band-shaped package are formed of same material in a preferred embodiment, and are formed by one piece of resin sheet that is folded at around its centerline in an especially preferred embodiment. By such a manner, fusion-bonding property is easily given and feeding and recovering of the resin sheet or the like are facilitated. Thickness of the resin sheet is preferably 10 through 300 μm and more preferably 30 through 80 μm.

The electronic, electric or other products to be placed in the band-shaped package are flat in configuration. Ratios of thickness to length and breadth of the products are at least 1/5 and typically 1/10 through 1/100. The electronic or electric products encompasses not only flat panels or flexible sheets but also substrates mounted with a various small parts for example, and is possibly be panels having some curvature. Moreover, the flat products may be works for producing parts for precision machinery, or the like, other than the electronic or electric products. In a preferable manner, the electronic, electric or other flat products in same kind are arrayed in the band-shaped package at a constant interval. Nevertheless, the two or more kinds of the products may be arrayed in some proper order; and interval between them may be suitably adjusted, for example, by taking a large interval between the receptacles at which production lot is switched to other one.

In a preferred manner, positioning of the electronic, electric or other flat products is given when the receptacles are formed by the joining. That is, the products arrayed in a resin-sheet band are further adjusted in their position and secured in such position, at a time of the joining. For example, due to tensional stress of the sheet applied on edges or corners of the products, they are kept as not to be positionally shifted. If some extent of positional shifting in widthwise direction of the band-shaped package is allowed, positioning and securing of the products may be made in respect of longitudinal direction of the band-shaped package, at the time of the joining.

The electronic or electric products especially suitable for being contained in the invention-wise band-shaped package are display panels before and after attaching connector boards; preferably those of diagonal dimension of the viewing area of no more than 10 inch, more preferably no more than 8 inch, further preferably no more than 4 inch. The display panels are typically liquid crystal display panels, whereas the same goes for organic EL (electroluminescence) panels, inorganic EL panels or the like. The display panels to be contained are preferably those formed of glass substrate or the like that are relatively susceptible to damage or fracture. Other examples of the flat electronic or electric products are backlight devices, light-guide plates, driver circuit boards or the like, for flat-panel display devices, which have dimensions substantially equal to the above-mentioned display panels, that is, for small and medium sized flat-panel display devices.

The band-shaped package preferably has fringe extension areas extended from the resin-sheet band on both sides on the row of the receptacles. The fringe extension areas take a role as shock absorber or cushioning when the band-shaped package is wound around an axis or folded in.

When to take out the electronic, electric or other products from the band-shaped package, it is necessary to successively open up the band-shaped package, preferably in a manner to make the products successively retrievable, as to successively supply the products to a next processing or the like. In a preferred embodiment, the band-shaped package is easily opened up by applying a tensional stress necessary for separating the obverse and reverse sheet parts of the resin-sheet band. In another preferred embodiment, the obverse sheet part is provided with a to-be-broken portion along a fringe of the band-shaped package so that tearing of the obverse sheet part may be made successively from one end of the band-shaped package in a manner the receptacles are opened up successively.

When for facilitating the retrieving by peelable or separatable joined areas, the band-shaped package preferably has a double-margined fringe extension area at which two fringe areas of the resin sheet(s) are overlaid as not joined together. Separation of the sheet parts is easily made by successively drawing apart the two fringe areas. In otherwise, by drawing apart of the two fringe areas, one of the receptacles may be opened up at any position on an intermediate between two ends of the band-shaped package as to facilitate sampling inspection of the products. For example, a display performance test as called as dynamic operating inspection is made to a display panel module. At the double-margin fringe area preferably, one of the fringe extension areas preferably jutted out from another one as to facilitate the tearing apart.

When for facilitating the retrieving by the to-be-broken portion, the to-be-broken portion is provided on one of the obverse and reverse sheet parts, preferably on the obverse sheet part. The to-be-broken portion is preferably broken when undergoing some separating-apart-wise stress; thereby enabling easy and separate opening of one of the receptacles at intermediate portion between ends of the band-shaped package. The to-be-broken portion is for example formed by openings in a row such as dotted line or broken line or by scraping surface of the sheet part in a sectional shape of a notch as to be extending in a line.

By adopting a manner of the successive packing and unpacking, storage spaces for the traveling trays and/or retrieving mechanisms for the trays are omitted at nearby of the assembling sites. The packing may be made immediately and successively after production of the electronic or electric products and the unpacking of the products may be made just before a subsequent assembling, so that attaching of foreign particles are minimized.

In a preferred embodiment in the method for producing the band-shaped package, the package is formed by a following manner of feeding of the electronic, electric or other flat products. While a resin sheet is folded as to form a V-shaped section opened upward, the flat products are dropped into or slid into such opening of the V-shaped section. By some stopper action, the products are stopped before arriving bottom end of the V-shaped section and positioned in width direction of the band-shaped package.

In another preferred embodiment in the method for producing the band-shaped package, pockets are provided on beforehand, by joining obverse and reverse sheet parts of the flat resin-sheet band, at necessary or appropriate areas. A packing device for producing the band-shaped package has horizontally feeding area and vertically feeding areas. In the horizontally feeding area, distance or space between the sheet parts is opened up along opening of the pockets by a sheet-opening guide; and in such opened state, the electronic or electric products are successively inserted to the pockets. Transition from the horizontally feeding area to the vertically feeding area is made by sliding on a curved face that makes path length of the resin-sheet band constant and has a cutout. The vertically feeding area is provided with a heat sealer that is for closing the pockets if necessary or appropriate. By combining the horizontally and vertically feeding areas in this manner, space for placing the packing device become small. Moreover, when the pockets are closed during feeding of the resin sheet downward, the resin sheet is fully stretched so that wrinkle and stress or torsion are avoided when forming the joined areas.

In a preferred embodiment of the band-shaped package, vacant receptacles are formed at interval of certain number of the receptacles, which enables folding of the band-shaped package in a winding form or in a zigzag form. One ends of the band-shaped package is made to be a lead portion that is formed of a consecutive row of the vacant receptacles or of a sheet part without joined areas.

In a preferred embodiment, the band-shaped package is wound around by itself or around a shock-absorbent core, as to be kept or transported in such a state. In an other preferred embodiment, the band-shaped package is alternately folded in a waveform as to be kept or transported in such a state. In either of these states, the air or other gas contained in the receptacles may serve as a shock absorber. When folded alternately in the waveform, in a preferred embodiment of encasement of the band-shaped packages, storage casing such as cardboard box has a plurality of compartments that are separated from adjacent ones and from outer wall by shock-absorbent gaps and/or layers.

The shock-absorbent core, around which the band-shaped package is wound, may not only be paper board such as cardboard but also be resin foam, non-woven fabric, woven or knitted fabric, or either of various paper products, and may also be a consolidated pulp sheet or the like. Shaping of the core may not only be a flat board of substantially rectangular contour but also be a corrugated sheet or board, a bag or the like, and may be a tube or a hollow body having an oval or circular cross section. Mentionable as especially preferred is the core formed of cardboard having honeycomb construction. The core formed of cardboard may be punched out from a large-size untrimmed paper board into a rectangular shape or other shape. The core formed of cardboard may be recycled as used paper when the core has become no use any more. It is preferred when a flat core such as a board is used and the band-shaped package is wound therearound to form a to-be-cartoned or cartoning-wise-package unit in a flat configuration as a whole, because a flat components such as a flat display panel would be retained in a stable manner by and within the inner box and thus be protected from shock or vibration incurred from outside. A rubber band, a braid or string, and/or an adhesive tape may be used to keep and secure the state the band-shaped package is wound around the core.

Each of the cartoning-wise-package package units, which is formed by winding the band-shaped package around the core, is placed into an inner box that is then placed in an outer box, or is directly placed into a compartment of the outer box arranged with partitions. Placing the cartoning-wise-package units in the inner box and then in the outer box is preferred in view of protecting from damage and vibration. The inner box for receiving the cartoning-wise-package unit as well as the partitions in the outer box may be formed of any of the shock absorbent materials that have been mentioned as applicable for the core. In otherwise, the core may be formed of elastic material as to be deformable, which is not shock absorbent as itself. It is nevertheless preferable when the cores, the inner boxes, the partitions and the outer box, or all of the cartoning-wise packaging media are formed of same material, in view of material recycling after repeating of use of the cartoning-wise packaging media. It is especially preferable when all of the cartoning-wise packaging media are formed of cardboards with a uniform or similar thickness, because fabrication processes for the cartoning-wise packaging media would be simplified as to cut down fabrication cost and recycling of the materials would be facilitated. For example, it is preferable when the cartoning-wise packaging media are formed by punching or cutting out from untrimmed cardboards and then by folding or assembling of the punched out or cut out cardboards, because cost of the materials and fabrication as well as procedural-steps-wise burden are minimized and because reuse as well as recycling and recovery are facilitated. Even when incinerated, adopting of plant-fiber based materials such as paper boards curbs problems of releasing toxic gas or the like.

The inner box is preferably formed in a shape and dimensions that are neither more nor less than those for receiving the cartoning-wise-package unit. Typically, the inner box is formed as flat or small-depth to match flat shaping of the cartoning-wise-package unit. Such flat inner box is preferably formed to be openable in a manner as a bivalve shell, that is, to be comprised of an end face part being like a "hinge section" and two or front and rear main-face parts that open up and close down by turning around the end-face part, with each other. When constructed in this way, the cartoning-wise-package unit is sandwiched by the two main-face parts and, resultantly is retained in the inner box with no excess play and easy to be put in and taken out. Flaps or the like extended from fringe of the two main-face parts are overlapped or engaged with each other, at top face part or lateral-end parts of the inner box when the "hinge-wise" end-face part is taken as bottom face of the inner box. If the flaps overlap with each other at top face part of the inner box, flaps on the lateral-end face parts of the inner box may be omitted.

In order that the core is directly retained by the inner box, the core may be sandwiched by the flaps or the likes that are extended from the front and rear main-face parts, or in otherwise, protrusions may be provided on the core so as to engage with holes or incisions on the hinge-wise end-face part and with holes or incisions the flaps on the top-face parts. Meanwhile, partitions in the outer wall is preferably arranged and constructed to form storage compartments (or compartment) for inserting the inner boxes and void chambers for separating the storage chamber(s) from inner wall face of the outer box. It is preferable in general when the void chambers are formed to encircle storage compartment (s) from lateral directions of the outer box. Nevertheless, the void chambers may also be made at between bottom face of the outer box and an array of the storage compartments (or the storage compartment), and/or between flaps and the array of storage compartments (or the storage compartment). The storage compartments and the void chambers may be easily fabricated by putting together the partitions that are formed of shock-absorbent or flexible sheets or boards in a lattice or matrix-forming arrangement. Usually, a plurality of the storage compartments is formed in the outer box as to receive a plurality of the inner boxes. For example, the sheets or boards having provided with cut-ins or incisions are assembled with each other at the cut-ins and then arranged in the outer box. In this way, the plurality of the storage compartments and the void chambers surrounding the storage compartments from lateral directions of the outer box. In such a partitioning arrangement, spacers formed of shock-absorbent material may be arranged between the inner box and bottom of the outer box and between the inner box and flaps of the outer box, as to easily achieve retaining of the inner box in vertical direction and protection from vertical mechanical shock. For example, spacers having cross sections of rectangular shape, angled-C shape, "V" shape or the like may be arranged between the inner box and the bottom and between the inner box and the flaps. In place of such folded ones, vertically arranged flat sheets that are narrow in vertical direction and have been provided with the cut-ins or incisions are assembled with the fore-mentioned partitions arranged in vertical direction.

In some cases, the partitioning arrangement formed of the partitions may be replaced by a construction in which the plurality of the inner boxes are stacked or arrayed, and retained in the outer box, with some proper spacers interposed between them. For example, the spacers may be arranged not only on the bottom face in the outer box but also on whole of inner circumferential faces of the outer box and between the inner boxes. As the spacers, bags filled with the air may be used; and the air will be removed at time of recovery for sending back.

In a preferred embodiment in respect of the receptacles, these are sealed off from the air, and thereby, the electronic or electric products contained in the receptacles are protected from intrusion of foreign particles and moisture. The receptacles may be sealed off independently from each other, or in otherwise, may be continuous with each other through adequate communication channels or ports. At a time of the sealing off, inside of the receptacles may be replaced with inert gas such as nitrogen or carbon dioxide gas, or in otherwise may be vacuumed to be vacated with oxygen. For example, the sealing off is made in a vacuum chamber, and under the air, the resin sheet is tightly contacted on outer faces of the electronic, electric or other flat products that are contained in the band-shaped package. Moreover, moisture absorbent and/or deoxidizer may be placed in the receptacles when these are sealed off from the air. For example, a layer of polyvinyl alcohol is provided on inner face of the resin sheet as a moisture absorbent layer.

In another preferred embodiment in respect of the receptacles, the pockets are remained as opened as the electronic, electric or other flat products are readily taken out and reinserted. Namely, an insertion opening of the each pocket is remained to be opened. In this manner, the resin-sheet band with receptacles is repeatedly used for transporting the flat products, between nearby work sites for example. Moreover, the flat products may be charged into an autoclave, a reactor vessel, or a processing chamber in a state contained in the receptacles of the resin-sheet band, as to be subjected to processing such as vacuuming, pressurization, heating, cooling, pressing, warm air blowing, gas substitution, aging, cleaning and the like. In other words, the resin-sheet band with receptacles may be used in place of the cell rack.

When for using repeatedly or as a multi pocket holder for processing, the resin-sheet band is preferably formed of resin with high durability or high heat resistance. Other than the polyethylene (PE) or its copolymers mentioned above, polypropylene (PP), polymethylpentene or the like may be used. As resins with higher durability or heat resistance, polyethylene terephthalate (PET), polyethylenenaphthalate or the like maybe used; and in some occasions, fluorocarbon resins such as ethylene tetrafluoro-ethylene copolymer (ETFE), fluoroethylene-propylene copolymer (FEP) may also be used. For imparting antistatic property to these resins, a mesh layer formed of electric conductive fibers may be overlaid as attached.

The resin sheet of the band-shaped package may be printed with alphabetical or other letters, or with marks or symbols for indicating information such as device types, product varieties, production lots, production dates, destination sites, destination devices and alarms on handling. For example, instead of making an engraved mark or attaching a label on the electronic, electric or other flat product, information or alarming necessary for subsequent processing may be indicated by a bar code, a row of marks or letters for alarming, or the like as to be read out when the products are taken out from the band-shaped package.

The band-shaped packages and method of packing explained hereto may also be used for shipping of the intermediate or final products. By such way of packing, the products may be placed in the package immediately after finishing, one after the other or in sequence; and then taken out from the package as to be used or sold, one after the other or in sequence.

EMBODIMENT

Figure 5:
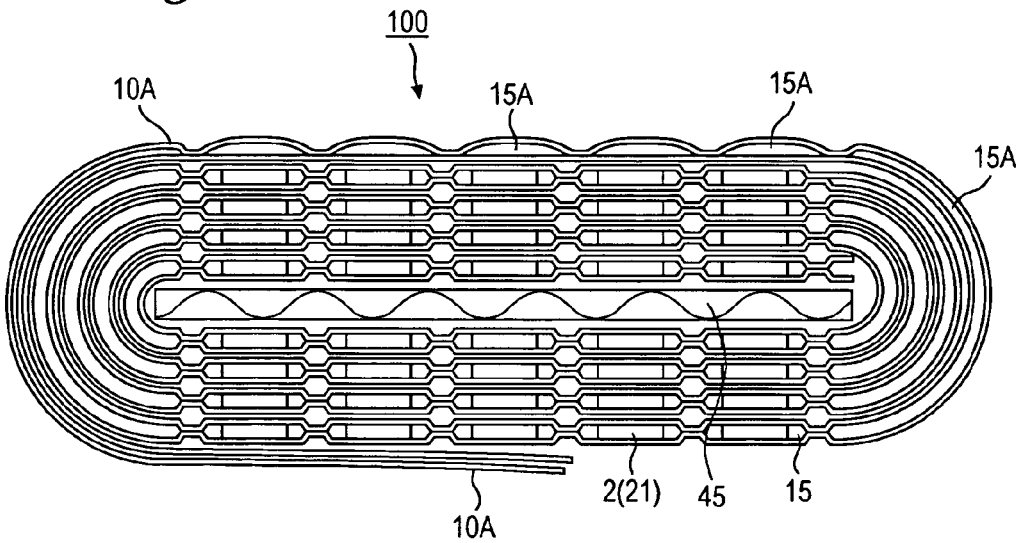
FIG. 5 is a schematical cross sectional view showing the to-be-cartoned package unit in which the band-shaped package is folded at its portions having vacant receptacles.
Figure 6:
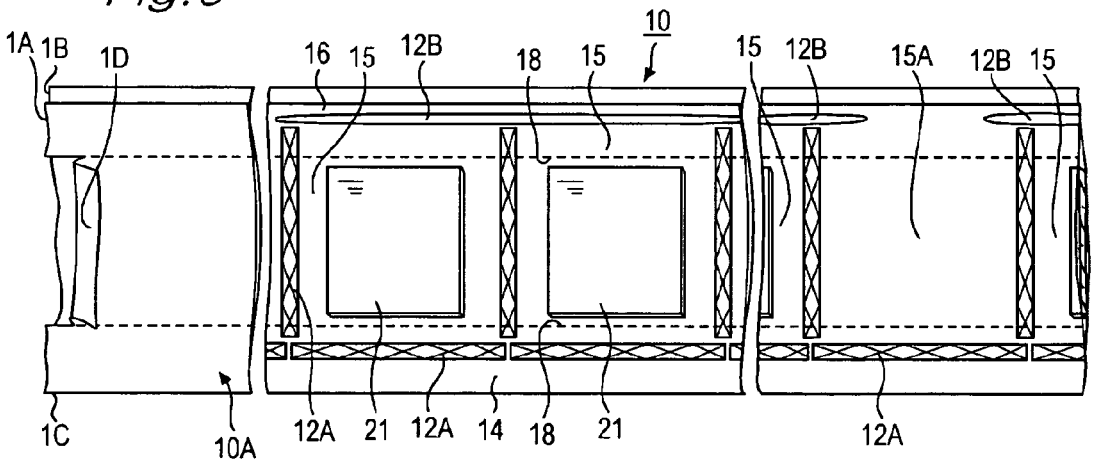
FIG. 6 is a plan-view-wise perspective view showing an example of a band-shaped package having display panels proper.

First embodiment of the invention will be explained by use of FIGS. 1-7. FIGS. 1-5 show a way of cartoning of the band-shaped package 10 for its transportation and storage. FIG. 5 among them shows a cartoning-wise-package unit 100 that is comprised by a core 45 as a rectangular cardboard sheet and a band-shaped package 10 wound around the core 45. FIGS. 1-4 show in a sequence how the cartoning-wise-package unit 100 is cartoned in an inner box 46 and then how the inner box 46 is cartoned in an outer box 4 arranged with partitions 41. FIG. 6 shows the band-shaped package 10 in which display panels proper 21 are enclosed, while FIG. 7 shows the band-shaped package 10 in which display panel modules 2 are enclosed.

The display panel module 2 is comprised of a display panel proper 21 (not including connector wiring board or other attachments), a connector wire board 22 connected to the display panel proper 21, a frame 23 for retaining a periphery of the display panel proper 21, and a backlight device. In a detailed example, the display panel module 2 is to be assembled into a foldable mobile phone and the connector wiring board 22 is formed of a flexible printed circuit board (FPC) and controllers or the like attached thereon. The display panel proper 21 is formed of a pair of glass substrates and a liquid crystal material filling a minute gap between the substrates as to be enclosed in the gap. The display panel proper 21 is, for example, one having a polysilicone TFT (thin-film transistor) on each of pixel dots as a switching element, and has a 3-inch diagonal dimension for the viewing area.

A resin sheet 1 comprising the band-shaped package 10 is, in a detailed example, a transparent sheet that is formed of; a base layer consisting of a non-cross linked low-density polyethylene; and an antistatic sealing-resin layer consisting of potassium ionomer of the ethylene unsaturated ester copolymer.

Figure 7:
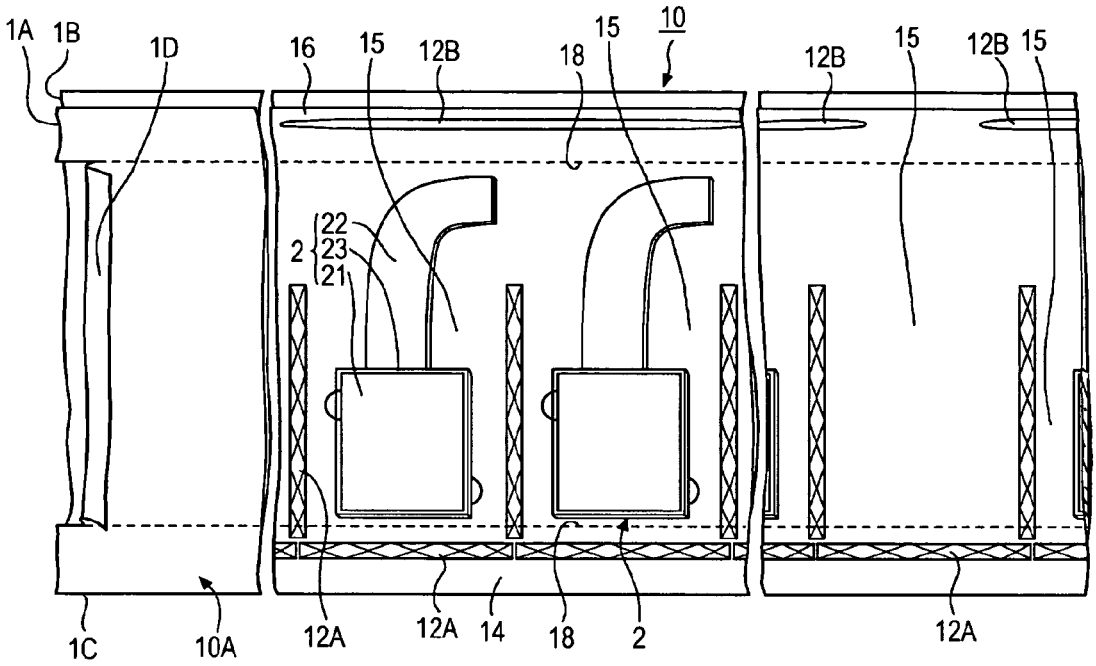
FIG. 7 is a plan-view-wise perspective view showing another example of a band-shaped package having display panel modules.

As shown in FIGS. 6-7, the resin sheet 1 is folded at vicinity of its centerline as to sandwich the display panel modules 2. In other words, the display panel modules 2 are sandwiched as retained by obverse sheet part 1A and by reverse sheet part 1B that is folded back while folded portions 1C makes a fringe of a resin-sheet band or a folded resin sheet. The antistatic sealing-resin layer comes inside of the resin-sheet band. At along fringe of the resin-sheet band opposite to the folded portions 1C, a double-margined fringe area is formed as the reverse sheet part 1B protrudes by a small dimension from the obverse sheet part 1A.

In an example shown in FIGS. 6-7, readily peelably joined areas 12A and more firmly joined areas 12B on the band-shaped package; the readily peelably joined areas 12A are formed on beforehand of placing the display panels 21, by the ultrasonic bonding as to make each pocket. Meanwhile, the firmly joined areas 12B are formed after inserting a display panel proper 21 into the each pocket as to close the pocket and form each receptacle 15, by use of heat sealer using an impulse sealer.

In a concrete example on dimensions, width of the band-shaped package 10 is 150 to 200 mm, and widths of the fringe extension areas 14, 15 are 10 to 30 mm; dimension of the each receptacles 15 along longitudinal direction of the band-shaped package is 50-100 mm; width of the peelably joined areas 12A is 5 to 15 mm for example, width of the firmly joined areas 12B is 1 to 10 mm for example, and thickness of the resin sheet 1 is about 50 μm for example. The resin sheet 1 has been produced, for example by following manner: a tube is formed by an inflation molding and then is cut at one position in a longitudinal direction, and subsequently wound around the roll 31 while being folded along a certain position.

The band-shaped package 10 shown in FIGS. 5-7 has vacant receptacles 15A, each of which is disposed at interval of certain number of the receptacles 15. The band-shaped package 10 also has on its end, a lead part 10A that correspond for about 5 to 8 consecutive vacant receptacles 15A. The lead part 10A may be formed of either of the rows of the vacant receptacles 15A and/or a part of resin sheet that is merely provided with the to-be-torn line 18 and not with the joined areas 12A that delimit the receptacles.

In an illustrated example of the FIG. 5, each of the vacant receptacles 15A is disposed to next of every five consecutive receptacles 15 filled with the display panels. The band-shaped package 10 is folded at the vacant receptacles 15A as to be wound around a core 45, which is a rectangular cardboard sheet in a detailed example. The band-shaped package 10 is cartoned and transported in a form of the cartoning-wise-package unit 100; and the lead part 10A comes to outermost of the cartoning-wise-package unit 100 and serves as a cushion.

By forming each of the vacant receptacles 15A after forming a predetermined number of the receptacles 15 filled with the display panels as in above, number of the display panels in a cartoning-wise-package unit 100 is easily counted. When folding is made after every five consecutive ones of the filled receptacles 15, the number is easily grasped by counting number of layers and multiplying it by 5.

In the band-shaped package shown in the FIGS. 6-7, each of delimiter between the receptacles 15 filled with the display panels or the like is consisting of a single line of the joined area 12A; and the vacant receptacles 15A are disposed at interval of certain number of the receptacles 15. Such construction of the band-shaped package is suitable for a manner of cartoning-wise packaging as shown in FIG. 5, in which the band-shaped package 10 is folded at the vacant receptacles 15A.

In following, a manner of cartoning-wise packaging according to the embodiment illustrated in FIGS. 1-4 is explained in detail. FIG. 1 is a perspective view showing the inner box 46, in a state as opened up, for receiving the to-be-cartoned or cartoning-wise-package unit 100 one by one, and also showing the cartoning-wise-package unit 100. The inner box 46 is a flat and rectangular tube-shaped box formed by folding a rectangular sheet of cardboard, which is comprised of; front and rear main-face parts 463 and 464 in a rectangular shape; a narrow bottom-face part 465 connecting long-side fringes of the front and rear main-face parts 463 and 464; and flaps 466 and 467 that are extended from another long-side fringes of the main-face parts 463 and 464 and overlap with each other when the inner box is closed down.

As shown in the figures, each of the flaps 466 and 467 and the bottom-face part 465, in vicinity of its right-hand and left-hand ends, has slits 468. In the illustrated example, each of the slits 468 has identical dimensions and shaping; and the slits 468 are disposed at same positions when seen from above, between the first and second flaps 466 and 467 and the bottom-face part 465. In the illustrated example, width dimension of the slits 468 are almost same with thickness of the cardboard consisting the core 45. Meanwhile, no flaps are provided on short-side fringes of the main-face parts 463 and 464, so that the short-side fringes are free edges and lateral-end parts of the inner box 45 remains to be opened even after closing down of the inner box 46.

Figure 2:
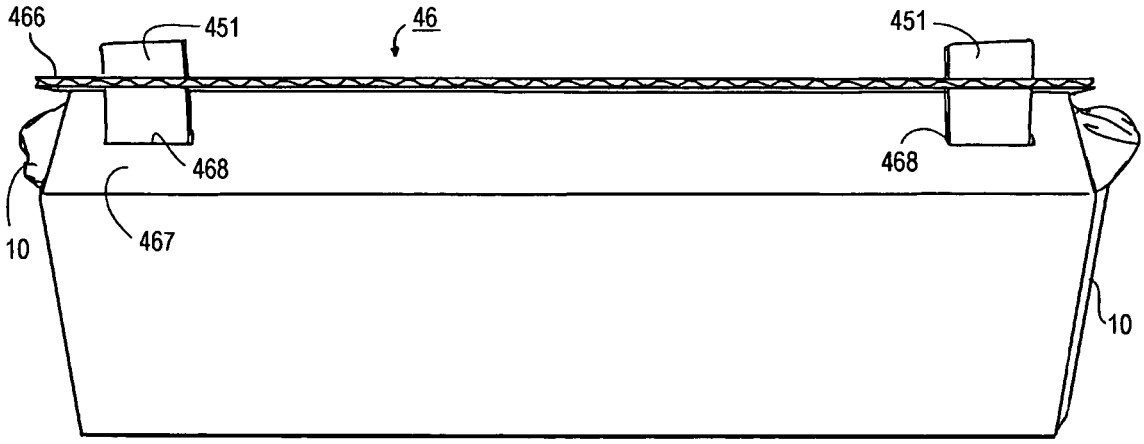
FIG. 2 is a perspective view seen obliquely from above showing the inner box that has received the to-be-cartoned package unit and has been closed up.

The core 45 is comprised of a rectangular part that almost matches the main-face parts 463 and 464 of the inner box 46, as well as protrusions 451 that extends from ends of both long-side fringes of each of the main-face parts. Each of the protrusions 451 extends in a direction along a short-side fringe of the main-face part and is inserted as rather tightly fitted in the slit 468. Procedures for placing the package unit 100 in the inner box 46 are as follows. Firstly, two protrusions 451 on bottom side of the package unit 100 are inserted into the slits 468 that are provided at the bottom-face part 465 of the inner box 46. Subsequently, the another two protrusions 451 on upper side of the package unit 100 are inserted into the slits 468 on the first flap 467, which is thus folded perpendicularly as to "close up" the inner box. Thereafter, as shown in FIG. 2, the second flap 466 is closed as like as the first flap 466 while the two protrusions 451 on upper side are inserted. Such insertion is made gradually by slightly bending of the protrusions 451, so that the first and second flaps 466 and 467 are rather tightly fixed with each other and with the core. Thus, when the inner box 46 is assembled up, the core 45 is retained in the inner box 46 as not to be positionally shifted; and the package unit 100 is sandwiched by the two main-surface parts 463 and 464 of the inner box 46, so that excessive bowing at center parts of the core 45 and the package unit 100 is curbed even when undergoing mechanical shock or vibration.

In the illustrated example of the cartoning-wise-package unit 100, strings 48 are tied around the package unit 100 in width-wise direction of the band-shaped package 10 so that such wound state is retained. Strings or braids having elasticity may be used for example; and fastening brace, rubber band, adhesive tape or the like may be used in place of the string. Such fastening medium may be omitted by that the band-shaped package 10 is wound around the core 45 and immediately placed in the inner box 46. For example, such wound state becomes almost fixed at a time that; the lead part 10A is sandwiched between the core 45 and the main-surface part 464 of the inner box and the protrusions 451 of the core 45 are inserted into the slits 468 on the bottom-face part 465 and the first flap 467.

Figure 3:
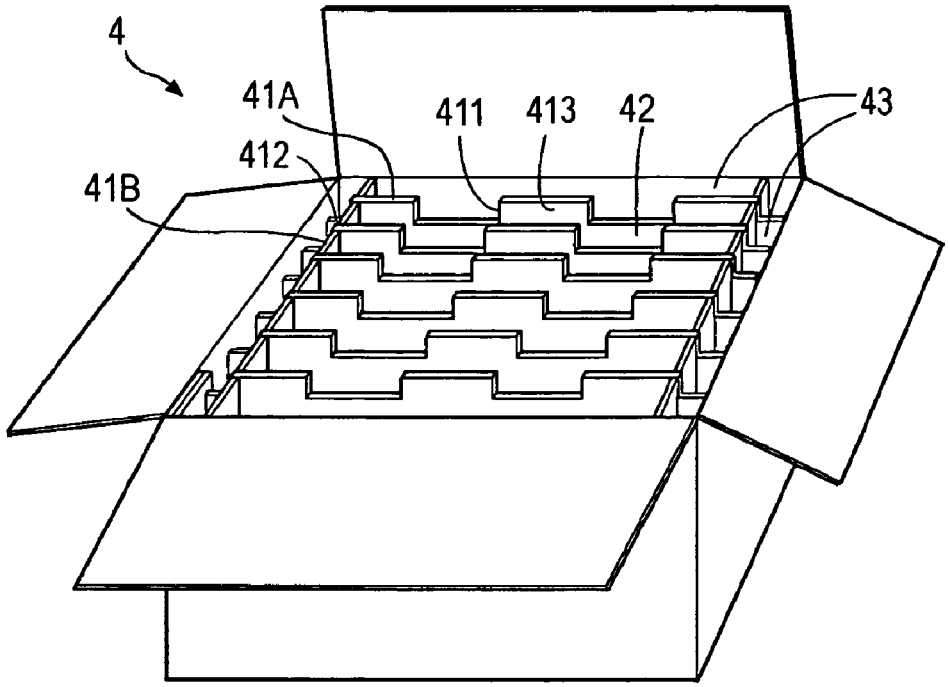
FIG. 3 is a perspective view seen obliquely from above showing an outer box having partitions in a lattice or multiple-cross arrangement and having flaps or lids in an opened-up state.

FIG. 3 shows the outer box 4 having the partitions 41, for placing the inner boxes 46. Number of first and second partitions 41A and 41B, which are formed of honeycomb-core cardboard same with those forming the outer box 4, the inner boxes 46 and the cores 45, are arranged to be substantially vertical and are assembled into a latticework as seen on a sectional view, at inside of the outerbox 4. Thus, five storage compartments 42 in a flat and rectangular shape are formed side by side; and number of void chambers 43 is formed along four lateral walls of the outer box 4. At each of upper and lower fringes of the partitions 41A arranged along the compartments 42, formed are two rectangular cut-outs 411 with angled-C-shape edge and thereby one rectangular protrusion 413 as remained between the cut-outs 411. Additionally, a rectangular cut-out 412 having an L-shaped edge is formed at each four corners of the first rectangular partitions 41A.

Figure 4:
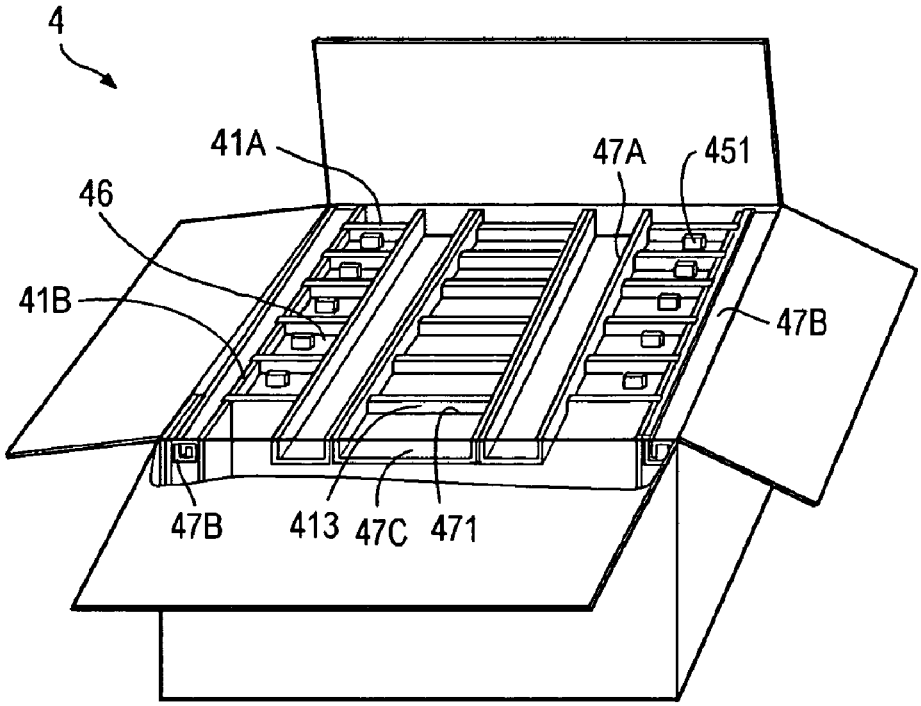

FIG. 4 shows a state where the inner boxes 46 are inserted as received in the outer box 4 shown in FIG. 3. As shown in the FIG. 4, each of rectangular cut-outs 411 on the first partitions 41A is fitted with a first cushioning spacer 47A formed of a cardboard, which is folded so as to run along inner faces of the rectangular cut out 411 and is same or similar with those forming the partitions 41 and the inner and outer boxes. The first cushioning spacers 47A are arranged in the outer box 4 in a manner as two at top portion of the outer box 4 and two on bottom of the outer box 4. The first cushioning spacers 47A keep the inner boxes 46 as separated from bottom of the outer box and from the flaps of the outer box. Meanwhile, second cushioning spacers 47B formed of cardboards, each of which is folded to form a square-shape cross section, are fitted with cut outs 412 on four corners of the first partitions 41A. The cushioning spacers 47B serve for maintaining sectional shapes of void chambers 43 that are outside of lateral ends of the inner boxes 46, so as to surely curb abutting of the lateral ends onto inner faces of the outer box 4 even when the outer box 4 undergoes shake-up or mechanical impact from outside.

As shown in the FIG. 4, a third cushioning spacer 47C having slits 471 and formed of the same or similar cardboard as the partitions and boxes is attached between each pair of the first cushioning spacers 47A; and, in detail, each of protrusions 413 at center parts on top and bottom fringes of the first partitions 41A is inserted into the slit 471 having same size as the protrusion 413. In this way, the first partitions 41A run along the compartments 42 are secured at their center parts by the third cushioning spacers 47C, and thereby prevented from deformation in a thick-wise direction of the compartments 42. Thus, the first partitions 41A would not excessively bow even when undergoing a shake-up or mechanical shock; as to further surely curb that load or mechanical shock is locally applied on the inner box 46 or the band-shaped package 10. In an illustrated example, the third cushioning spacer 47C having the slits has an angled-C-shape cross section; and left-hand and right-hand vertical walls of the third cushioning spacer 47C are overlaid on vertical walls of the first cushioning spacer 47A. In the illustrated example, cardboard-wise edge parts of the first, second and third cushioning spacers 47A, 47B and 47C are arranged to abut onto inner faces of the outer box 4.

Figure 8:
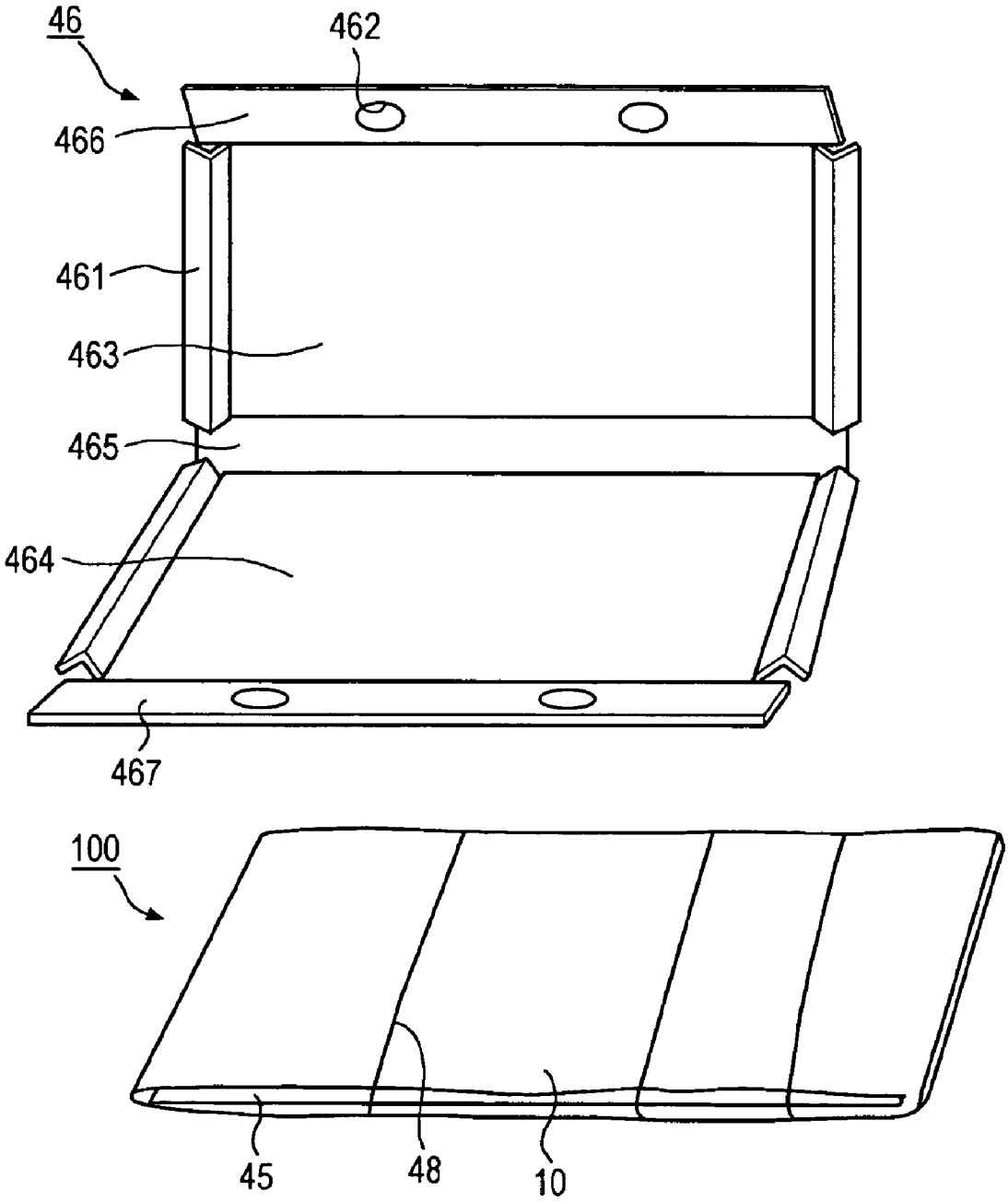
FIG. 8 is a perspective view corresponding to the FIG. 1, showing constructions of the inner box and the core cardboard according to a second embodiment.
Figure 9:
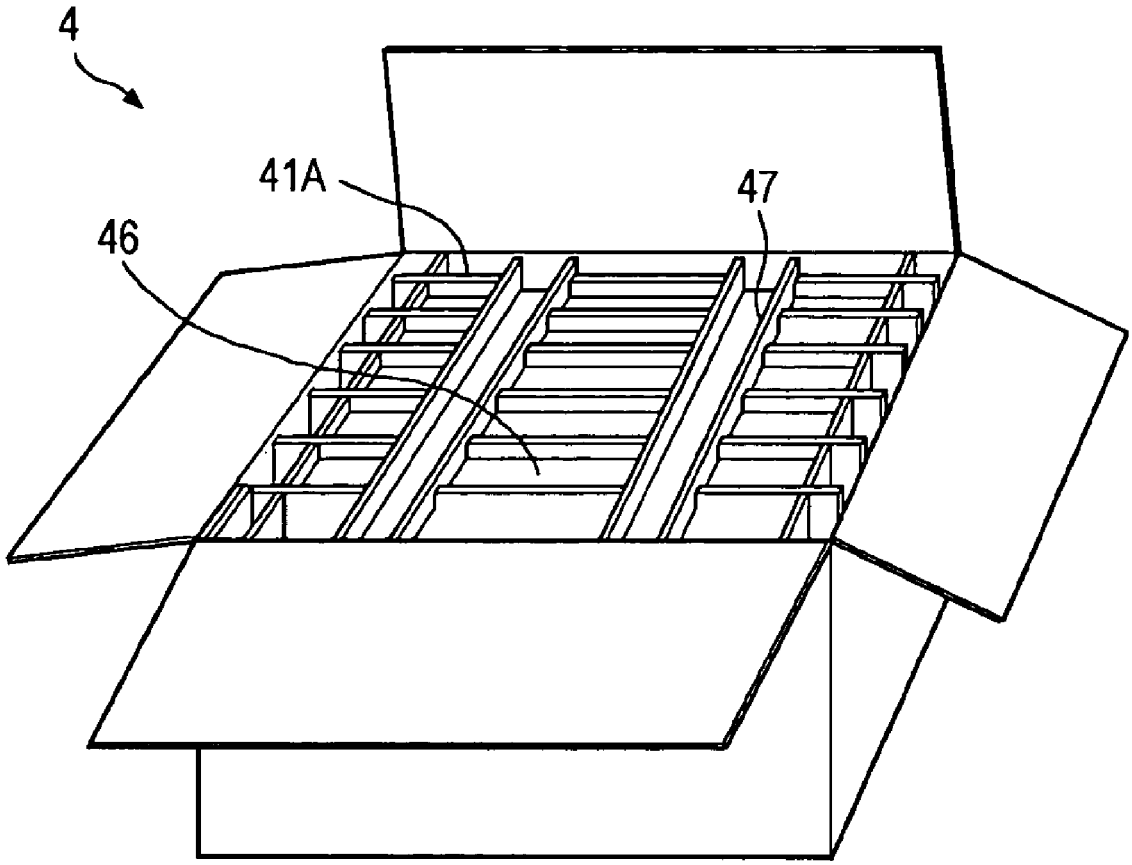

In following, second embodiment of the cartoning-wise packaging is explained by use of FIGS. 8 and 9. FIG. 8 is a perspective view that corresponds to the FIG. 1 and shows a construction of an inner box and a core; and FIG. 9 is a view that corresponds to the FIG. 4 and shows a state that inner boxes shown in FIG. 8 are inserted in the cardboard box having the partitions and the spacers are fitted therein. As shown in FIG. 8, the inner box 46 in the second embodiment is a flat rectangular box that may be obtained by making cut-ins on a rectangular cardboard and then folding it. In same manner with the first embodiment shown in FIGS. 1 and 2, the inner box 46 is a flat and rectangular box formed by folding a rectangular sheet of cardboard, which is comprised of; front and rear main-face parts 463 and 464 in a rectangular shape; a narrow bottom-face part 465 connecting long-side fringes of the front and rear main-face parts 463 and 464; and flaps 466 and 467 that are extended from another long-side fringes of the main-face parts 463 and 464 and overlap with each other when the inner box is closed down. The inner box 46 of the modified example further comprises clamping portions 461 having L-shaped cross sections that are extended from right-hand and left-hand short-side fringes of the main-face parts 463 and 464; and right-hand and left-hand end parts of the package unit 100 are held as sandwiched by the clamping portions 461 so that the core 45 that is a rectangular cardboard is held as clamped by the clamping portions 461 through vacant receptacles 15A on the band-shaped package 10. Moreover, each of the lids 466 and 467 of the inner box 46 has two circular holes 462, which enable inserting of fingers therein to and thus facilitate taking up of the inner box 46 when it is closed up. The inner box 46 of the second embodiment do not have mechanism for securing a closed up state while such closed up state may be secured by an adhesive tape or the like if needed. Meanwhile, the core 45 is shaped as a simple rectangle having no protrusions; and dimensions and shape of the rectangle is almost same as those for the front and rear main-face parts 463 and 464. In the illustrated example, strings 48 are wound around the cartoning-wise-package unit 100 so that such wound state is retained as in the foregoing embodiment.

In the second embodiment, as shown in FIG. 9, the partitions 41 and spacers 47 in the outer box 4 are constructed as simpler than those shown in the FIGS. 3-4. Each of the first partitions 41A run along the storage compartments 42 has two rectangular cut-outs 411 on upper fringe and has two other rectangular cut-outs 411 on bottom fringe; and has no cutout on four corners of the over-all rectangular shape. Only two spacers 47, which are fitted into the rectangular cut-outs 411 having angled-C-shape edge, are arranged on each of top and bottom portions of the outer box 4.

What is claimed is:

1. A method for manufacturing electronic, electric or other products, comprising:

sequentially placing first and flat products as to be sandwiched by a resin-sheet band formed of one or pair of band-shaped flat resin sheet and as to be arrayed in a longitudinal direction of the resin-sheet band;

forming joined areas by bonding or fusing faces of the resin-sheet band as to form receptacles respectively for the first flat products;

thus forming a band-shaped package in which the first flat products are arrayed in a row in a longitudinal direction;

winding the band-shaped package around a shock-absorbent core and thereafter placing them into an inner box so that the shock-absorbent core is held as non-displaceable to the inner box;

placing the inner box in an outer box in a manner that the inner box is supported from inner face of the outer box through partitions or spacers that are arranged in the outer box, and thereby gaps or void spaces are interposed between the inner face and the inner box; and transporting or storing the first flat products in the band-shaped package and in the inner and outer boxes while keeping its sheet face in a substantially vertical direction, as to be used for producing second products.

2. A method for manufacturing electronic, electric or other products, according to claim 1, wherein protrusions provided on the shock-absorbent core are inserted to holes or slits provided on the inner box, when said placing into the inner box and during said transporting or storing.

3. A method for manufacturing electronic, electric or other products, according to claim 2, wherein the protrusions are provided on four corners of rectangular shape of the shock-absorbent core and are arranged as protruded in vertical direction during said transporting or storing.

4. A method for manufacturing electronic, electric or other products, according to claim 2, wherein the core, each of the inner box and the partitions or spacers are formed by punching or cutting and/or folding of a cardboard.

5. A method for manufacturing electronic, electric or other products, according to claim 1, wherein each of the core, the inner box and the partitions or spacers are formed by punching or cutting and/or folding of a cardboard.

* * * * *